US005509830A

United States Patent [19]

Garis, Jr.

[11] Patent Number: 5,509,830

[45] Date of Patent: Apr. 23, 1996

[54] MARINE PROPULSOR COOLING AND LUBRICATING SYSTEM

[75] Inventor: Chester A. Garis, Jr., Gloucester, Va.

[73] Assignee: Newport News Shipbuilding and Dry Dock Company, Newport News, Va.

[21] Appl. No.: 298,095

[22] Filed: Aug. 23, 1994

[51] Int. Cl.[6] ..... B60L 11/02

[52] U.S. Cl. ..... 440/6

[58] Field of Search ..... 384/317, 271, 384/272, 264; 310/87, 89, 90, 60 R, 61; 440/6; 114/337, 338, 20.2

[56] References Cited

U.S. PATENT DOCUMENTS

| | | | |
|---|---|---|---|
| 5,078,628 | 1/1992 | Garis, Jr. | 114/338 |
| 5,101,128 | 3/1992 | Veronesi et al. | 440/6 |
| 5,185,545 | 2/1993 | Veronesi et al. | 310/90 |

*Primary Examiner*—Edwin L. Swinehart
*Attorney, Agent, or Firm*—Lalos & Keegan

[57] ABSTRACT

In a marine propulsor which includes an electric motor with a rotor, a bearing assembly supporting the rotor, and a plurality of propulsor blades and a blade assembly driven by the motor, improved cooling/lubricating system includes an inlet through which coolant/lubricant is supplied to the bearing assembly and the motor, a passage communicating with the inlet through which the coolant/lubricant flows, and an outlet located adjacent the trailing edge of the blade assembly through which the coolant/lubricant is expelled, whereby the expulsion of coolant/lubricant through the outlet provides additional forward thrust to the propulsor. The outlet may be located in the blade hub of the blade assembly or, alternatively, the outlet may comprise a plurality of holes located in the trailing edges of the blades of the blade assembly.

19 Claims, 3 Drawing Sheets

MARINE PROPULSOR COOLING AND LUBRICATING SYSTEM

FIELD OF THE INVENTION

This invention relates generally to cooling and lubricating systems for a marine propulsor, and more particularly, to such systems that improve efficiency of the propulsor.

BACKGROUND OF THE INVENTION

Various propulsion systems have been proposed for water-going vessels in which one or more propellers are disposed below the waterline of the vessel for surface vessels or disposed within a portion of the hull of submersible vessels. Typically, the propellers in submersible systems have been driven by diesel power, steam turbines or electric motors mounted within the hull of a vessel. A propeller shaft extends through the hull to the propeller mounted on the shaft outside the hull. Such systems have the disadvantages of shaft vibration and noise radiating from the shaft. Further, leaking around the shaft occurs when the seal becomes loose or worn. Alternative systems have been suggested using shaftless electric motors mounted outside of the hull with only electric power cables passing through the hull, as shown for instance in U.S. Pat. No. 3,182,623. A disadvantage of such a system is that propulsors (electric motors and impellers) occupy almost the entire interior of the tail section. Additionally, traditional shaftless electric motors are either too small to effectively move a vessel or, if large enough, add significant weight to the vessel.

An improved marine propulsor has been disclosed in U.S. Pat. No. 5,078,628, incorporated herein by reference. The propulsor comprises a shaftless electric motor with disk-shaped rotor and stators mounted in the vessel structure with a blade assembly mounted on the rotor. The blade assembly includes a blade hub and propeller blades extending beyond the circumference of the vessel housing. An improved bearing assembly for this propulsor has been disclosed in U.S. Pat. No. 5,286,116, also incorporated herein by reference. This bearing assembly comprises a bearing support, bearing cones circumferentially mounted on the bearing support and a rotating bearing member. The bearing assembly permits water to be introduced into the system through an opening in the bearing support and a gap between the bearing cones. The water supplied by this system cools the rotor and stators of the motor as well as the bearing members. The water also lubricates the rotating components. Thus, the water acting as both coolant and lubricant prevents overheating and excessive wear due to friction.

The pumping forces generated by the rotation of the rotor cause the water to flow through the propulsor. The water in this bearing assembly exits through the gap between the blade hub and the vehicle body on both sides of the hub. This water exiting at the inlet and outlet of the propulsor blades has been found to decrease the efficiency of the propulsor.

Accordingly, the object of the present invention is to provide an improved cooling and lubricating system for a marine propulsor which does not compromise the efficiency of the propulsor, and in which the coolant/lubricant is discharged on the trailing edge of the blade assembly. Other objects and advantages of the present invention will become more apparent from the following description taken in conjunction with the accompanying drawings.

SUMMARY OF THE INVENTION

The invention is directed to an apparatus for cooling and lubricating the bearing, rotor and stators of a marine propulsor driven by an electric motor. The propulsor includes blades mounted on a blade hub that is attached to the outer circumference of the rotor of the electric motor. The invention includes collector water passages disposed axially in the blade hub, coolant/lubricant exit passages disposed substantially radially in the blade hub, and coolant/lubricant outlets. The outlets may be either grooves cut into the blade hub intersecting the coolant/lubricant exit passages or, alternatively, a plurality of holes disposed in the trailing edge of the propulsor blades and communicating with the coolant/lubricant exit passages. In reverse operation, the coolant exits the propulsor conventionally past the effluent collectors. When operating in the forward direction, the exiting water adds to the forward thrust of the propulsor to increase the efficiency thereof.

DESCRIPTION OF THE PREFERRED EMBODIMENTS

Figure 1:
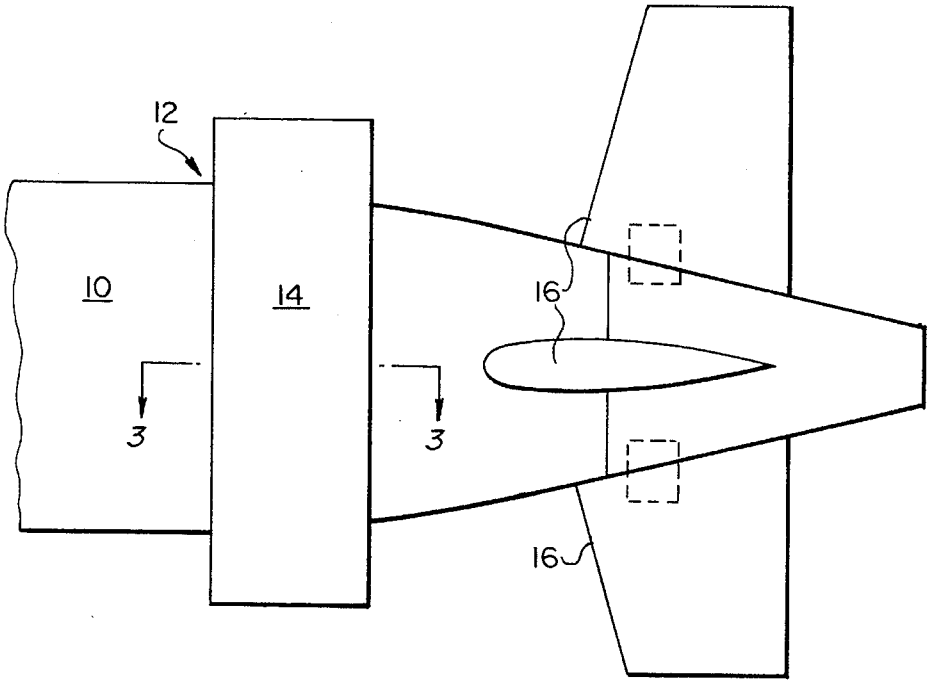
FIG. 1 is a fragmentary side elevation view of the aft section of a propulsor housing.
Figure 2:
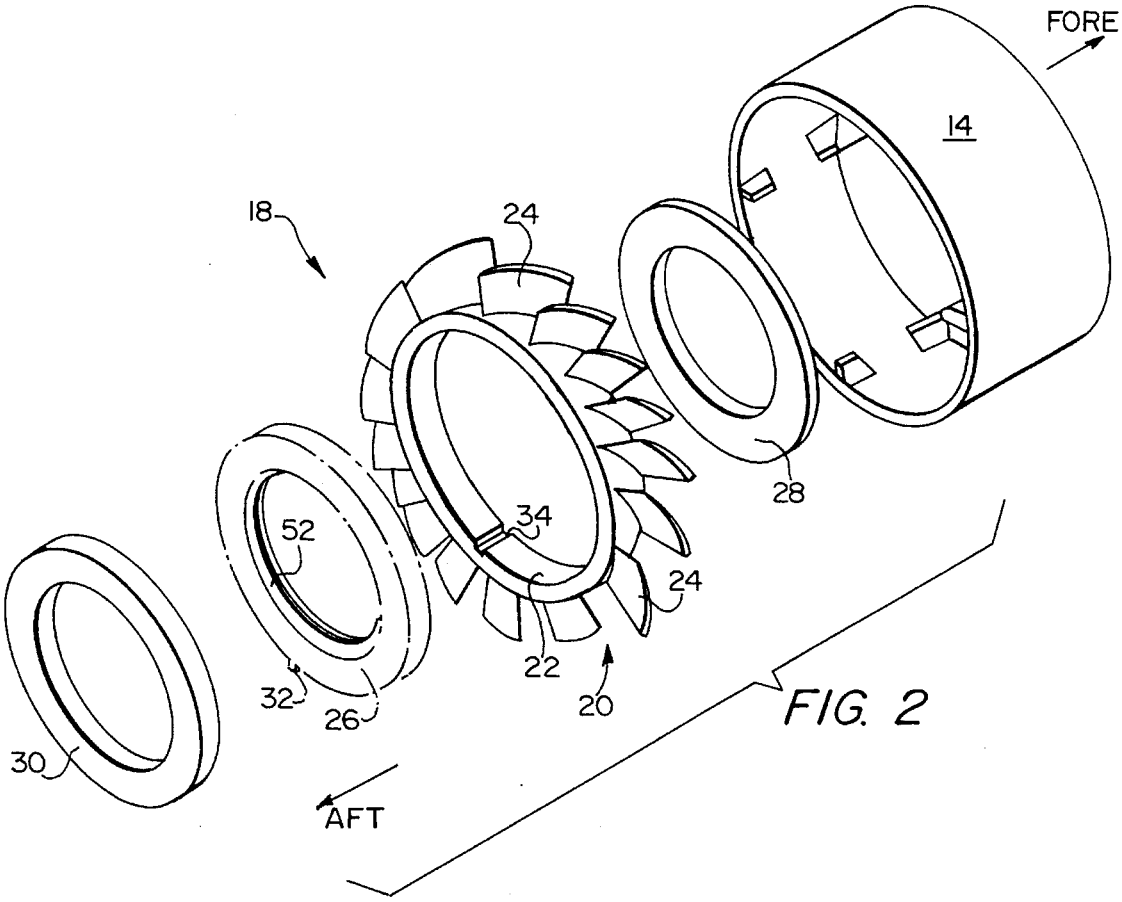
FIG. 2 is an exploded perspective view of the major components of the propulsor of the present invention.
Figure 3:
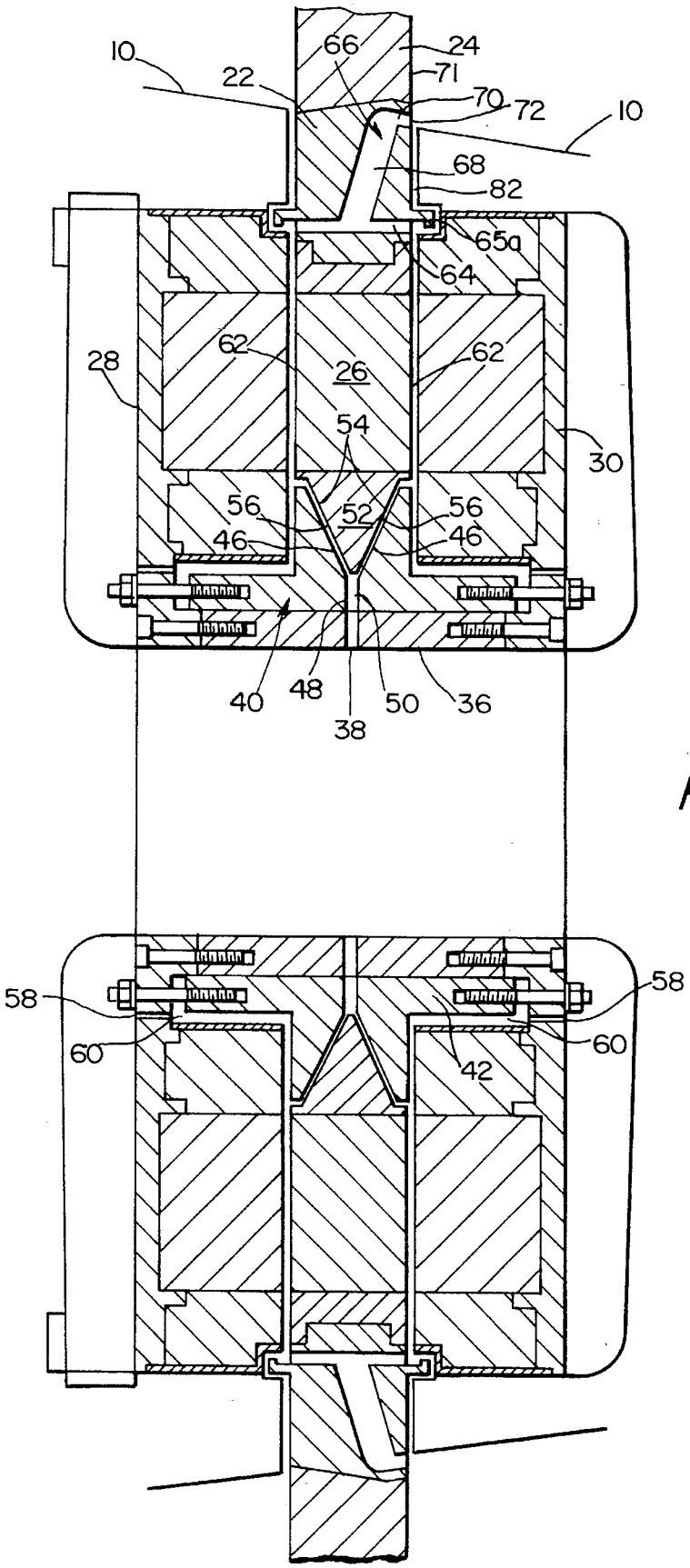
FIG. 3 is a cross-sectional view, taken along lines 3—3 of FIG. 1.

Referring to the illustration of the present invention shown in FIGS. 1–3, FIG. 1 illustrates a fragmentary view of the marine vehicle in which the present invention would be incorporated. This vehicle could be a submersible vessel, as shown for example in U.S. Pat. No. 3,101,066, in which instance body 10 may be a pressure hull. Alternately, the vehicle could be a surface vessel, in which instance the propulsor of the present invention may be mounted in a pod or cylindrical or cigar-shaped propulsor housing attached to the vessel below the waterline, as shown for example in U.S. Pat. No. 4,389,197. In either situation, the marine propulsor of the present invention will be installed in a section 12 of body 10, having generally a cylindrical or frustum shape or configuration. Also shown in FIG. 1 is a shroud 14 covering the blades of the propulsor assembly. Fins 16 may be mounted at the end of a submersible vessel or on an attached pod or propulsor housing.

FIG. 2 illustrates the general relationship of the major components of the assembly, with details omitted. The propulsor generally includes an axial gap motor 18 and an impeller 20 including a blade hub 22 and blades 24 forming a blade assembly. Motor 18 generally includes a rotor 26, a forward stator 28 and an aft stator 30. Blade hub 22 fits over rotor 26 with rotor keys 32 being received within hub key slots 34, thereby fixing hub 22 relative to rotor 26. As rotor 26 rotates, hub 22 and blades 24 are rotated through the water causing a propulsion force that is transmitted to the vessel through the improved bearing assembly of the present invention.

Referring to FIG. 3, the propulsor and cooling/lubricating system are shown in detail. The propulsor includes an axially disposed bearing support 36 about which rotor 26 rotates. Bearing support 36 includes at least one opening 38 through which the coolant/lubricant may flow, as is later described in detail. The coolant/lubricant may be ambient water that has been filtered.

Mounted circumferentially on bearing support 36 is a stationary bearing assembly 40 including two stationary bearing members 42 and 44. Each of the stationary bearing members includes an axial conical surface 46 at a first end 48 thereof. As seen in FIG. 3, the stationary bearing members are disposed with first ends 48 being adjacent to one another, but not abutting one another, such that a coolant/lubricant gap 50 is formed through which coolant/lubricant may flow.

A rotating bearing member 52 is provided rigidly supporting rotor 26. Rotating bearing member 52 has a pair of angularly disposed surfaces 54 adjacent to axial conical surface 46 of stationary bearing members 42, 44 to form a bearing clearance 56.

Lubrication and cooling of the bearing assembly is provided through coolant/lubricant openings 38 and gap 50 between first ends 48 of stationary bearing members 42 and 44. When a coolant/lubricant is introduced into openings 38, the coolant/lubricant travels by centrifugal force within gap 50 until it reaches the bearing clearance 56. The coolant/lubricant serves both to lubricate the bearing at the bearing clearance 56 and to cool the bearing surfaces. Additional cooling for the inside circumference of the stators is provided by coolant/lubricant inlets 58 on stators 28, 30 communicating with an inlet plenum 60. From inlet plenum 60 coolant/lubricant flows through flux gap 62, joining the flow from bearing clearance 56.

The combined coolant/lubricant flow is then carried out through the flux gap 62 between the rotor 26 and stators 28, 30 to effluent collectors 65. The effluent collectors 65 are in the form of a flange or cylindrical collar on both sides of the hub with rim or lip 65*a* extending generally in a parallel plane to the plane of the gap 62. In operation, the coolant/lubricant carries away heat generated in the stators 28, 30 and rotor 26. The effluent collectors 65 thus collect the coolant/lubricant that has passed through coolant/lubricant openings 38, gap 50, bearing clearance 56, coolant/lubricant inlets 58, inlet plenum 60 and flux gap 62. In normal forward propulsion, effluent collectors 65 on both sides of blade hub 22 serve to channel fluid flow into collector water passages 64, diverting it from passageway 82. In the embodiment shown in FIG. 3, effluent collectors 65 communicate with the collector water passages 64 that communicate with an effluent passage 66 located in blade hub 22. Effluent passage 66 includes a generally radially disposed portion 68 and an axially directed exit passage 70 that is generally in a direction adjacent the trailing edge 71 of blade 24 or blade assembly. The effluent flows through exit passage 70 and is discharged through outlet 72. Outlet 72 consists of a groove cut into the blade hub just below the blades 24 and radially outwardly from the body 10 at one end and intersecting the effluent passage 66 at the other end. This arrangement allows the force of the exiting water not only to add to the forward thrust of the propulsor but also prevent the exiting water from interfering with the water flow entering and exiting the propulsor blades.

Without the effluent collectors 65, effluent would proceed through flux gap 62 in a direction orthogonally to the hull 10 when the vessel is moving forward resulting in turbulence at the juncture of blades 24 and hub 22 on both forward and aft sides and thus a loss of efficiency.

Figure 4:
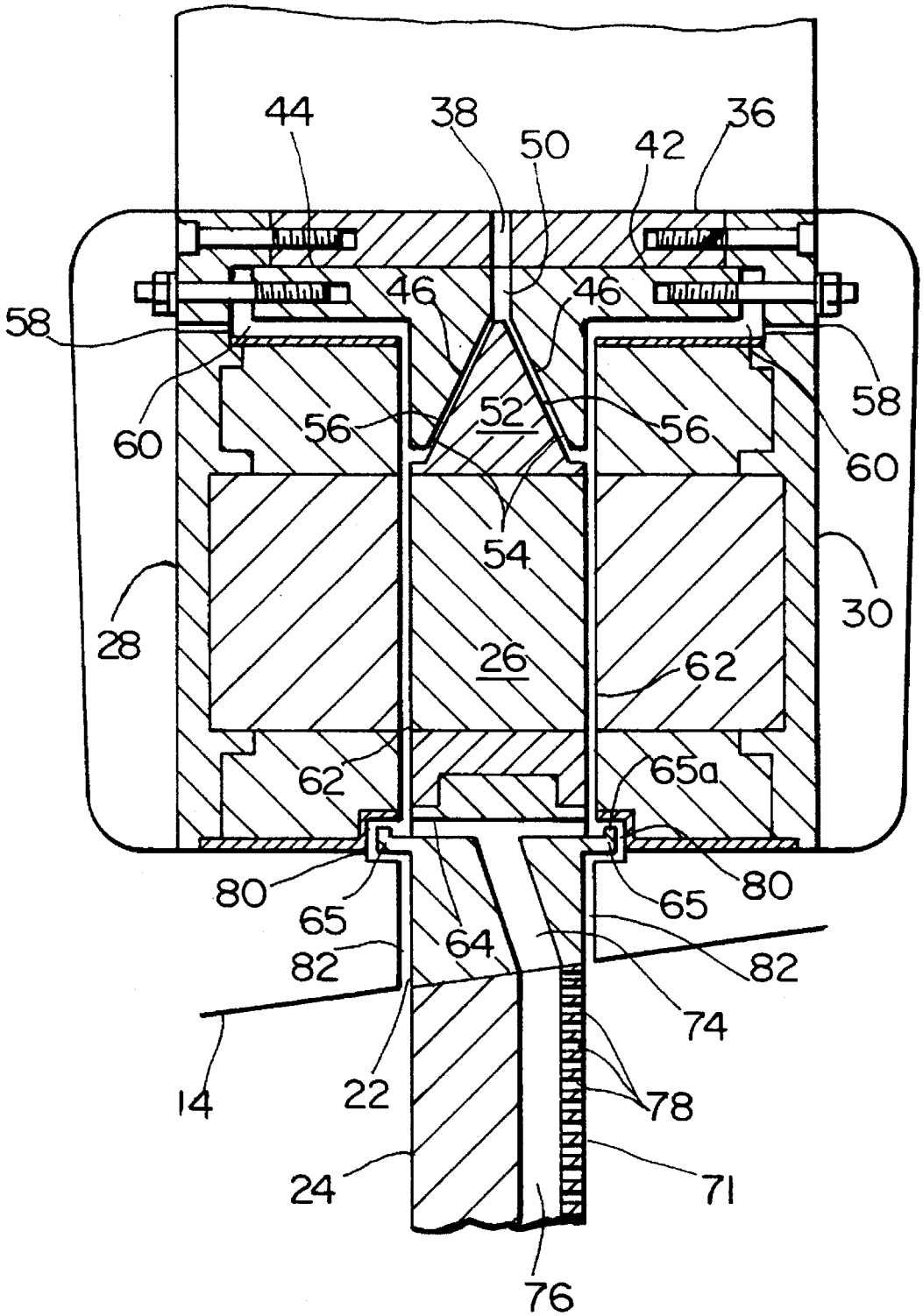
FIG. 4 is a cross-sectional view partly broken away and similar to that of FIG. 3 showing an alternate embodiment of the present invention.

Referring to FIG. 4, an alternate embodiment of the cooling/lubricating system is shown. In this embodiment, there are again provided effluent collectors 65 collecting the coolant/lubricant flowing through coolant/lubricant openings 38, gap 50, bearing clearance 56, coolant/lubricant inlets 58, inlet plenum 60 and flux gap 62. Here, however, collector water passages 64 communicate with a generally radially disposed intermediate exit passage 74 in blade hub 22. Intermediate exit passage 74 communicates with a radial exit passage 76 in blade 24. Communicating with exit passage 76 is a plurality of holes 78 in or adjacent the trailing edge 71 of blade 24 or blade assembly. This augments forward thrust and reduces turbulence as described above for the embodiment of FIG. 3. Additionally, the exiting of effluent through the holes in the trailing edge of the propulsor blade improves the acoustical properties of the propulsor.

The effluent collectors 65, collector water passages 64, effluent passages 66 and outlets 72 are designed to accommodate the volume of fluid entering the flux gaps 62 as specifically shown in FIG. 3. The blade hub 22 and the effluent collectors 65 including the flange and collar or rim structure are also designed with sufficient clearance so that water is permitted to flow around the effluent collectors 65 and exit through passageway 82 located between the blade hub 22 and the vessel body 10, as is the case in the existing propulsor previously described. This passage of effluent is required when the propulsor is operated in the reverse direction.

In another variant of the invention, the rotor bearing may be of a conventional sealed type. This would obviate the need for coolant/lubricant openings 38. Coolant/lubricant inlets 58, flux gap 62, effluent collectors 65, and the rest of the coolant/lubricant flow passages in the blade hub 22 and blades 24 would still be used, however, to provide coolant for the rotor 26 and stators 28, 30.

I claim:

1. An improved cooling and lubricating system for a marine propulsor, the propulsor including an electric motor with a rotor, a bearing assembly supporting the rotor, and a blade assembly including a plurality of propulsor blades and a blade hub attached to the rotor, the cooling and lubricating system comprising:

an inlet means in said propulsor through which coolant/lubricant is supplied to the bearing assembly and the motor, a passage means communicating with said inlet means through which the coolant/lubricant flows to cool and lubricate said bearing assembly and said motor, and outlet means communicating with said passage means located adjacent the trailing edge of the propulsor blade assembly through which the coolant/lubricant is expelled, and wherein the outlet means is located in the trailing edge of the blade hub.

2. An improved cooling and lubricating system for a marine propulsor, the propulsor including an electric motor with a rotor, a bearing assembly supporting the rotor, and a blade assembly including a plurality of propulsor blades and a blade hub attached to the rotor, the cooling and lubricating system comprising:

an inlet means in said propulsor through which coolant/lubricant is supplied to the bearing assembly and the motor, a passage means communicating with said inlet means through which the coolant/lubricant flows to cool and lubricate said bearing assembly and said motor, and outlet means communicating with said passage means located adjacent the trailing edge of the propulsor blade assembly through which the coolant/lubricant is expelled, and wherein the outlet means is located in the trailing edges of the blades.

3. A system according to claim 1 or 2, wherein the bearing assembly includes a bearing support, stationary bearing members and a rotating bearing member, wherein the motor includes a rotor mounted between a pair of stators, and wherein the inlet means comprises a coolant/lubricant opening in the bearing support and a coolant/lubricant inlet located in each of the stators.

4. A system according to claim 3, wherein the passage means comprises a bearing clearance provided between the stationary bearing members and the rotating bearing member.

5. A system according to claim 4, wherein coolant/lubricant is supplied to the bearing clearance by means of a coolant/lubricant gap between the stationary bearing members communicating with the coolant/lubricant opening.

6. An improved cooling and lubricating system for a marine propulsor, the propulsor including an electric motor with a rotor, a bearing assembly supporting the rotor, and a blade assembly including a plurality of propulsor blades and a blade hub attached to the rotor, the cooling and lubricating system comprising:

an inlet means in said propulsor through which coolant/lubricant is supplied to the bearing assembly and the motor, a passage means communicating with said inlet means through which the coolant/lubricant flows to cool and lubricate said bearing assembly and said motor, and outlet means communicating with said passage means located adjacent the trailing edge of the propulsor blade assembly through which the coolant/lubricant is expelled, and wherein the inlet means is located in the bearing assembly;

the bearing assembly includes a stationary bearing support, stationary bearing members and a rotating bearing member, said passage means comprising a bearing clearance provided between the stationary bearing members and the rotating bearing member and communicating with the inlet means;

the electric motor includes a rotor mounted between a pair of stators, and wherein the coolant/lubricant flows through a flux gap between the rotor and each of the stators, the flux gap communicating with the bearing clearance and the outlet means;

at least one coolant/lubricant inlet is located on each of the stators for supplying coolant/lubricant to the motor, and wherein an inlet plenum is formed between each of the pair of stators and the stationary bearing members, the coolant/lubricant inlets communicating with the inlet plenum.

7. An improved cooling and lubricating system for a marine propulsor, the propulsor including an electric motor with a rotor, a bearing assembly supporting the rotor, and a blade assembly including a plurality of propulsor blades and a blade hub attached to the rotor, the cooling and lubricating system comprising:

an inlet means in said propulsor through which coolant/lubricant is supplied to the bearing assembly and the motor, a passage means communicating with said inlet means through which the coolant/lubricant flows to cool and lubricate said bearing assembly and said motor, and outlet means communicating with said passage means located adjacent the trailing edge of the propulsor blade assembly through which the coolant/lubricant is expelled, and wherein the motor includes a rotor mounted between a pair of stators, and wherein a flux gap is provided between the rotor and each of the stators, the flux gap communicating with the passage means and the outlet means for conducting the coolant/lubricant;

at least one coolant/lubricant inlet is located on each of the stators for supplying coolant/lubricant to the motor, and wherein an inlet plenum is formed between each of the pair of stators and the stationary bearing members, the coolant/lubricant inlets communicating with the inlet plenum.

8. An improved cooling and lubricating system for a marine propulsor, the propulsor including an electric motor with a rotor, a bearing assembly supporting the rotor, and a blade assembly including a plurality of propulsor blades and a blade hub attached to the rotor, the cooling and lubricating system comprising:

an inlet means in said propulsor through which coolant/lubricant is supplied to the bearing assembly and the motor, a passage means communicating with said inlet means through which the coolant/lubricant flows to cool and lubricate said bearing assembly and said motor, and outlet means communicating with said passage means located adjacent the trailing edge of the propulsor blade assembly through which the coolant/lubricant is expelled, and wherein the bearing assembly includes a bearing support, stationary bearing members and a rotating bearing member, wherein the motor includes a rotor mounted between a pair of stators, and wherein the inlet means comprises a coolant/lubricant opening in the bearing support and a coolant/lubricant inlet located in each of the stators, and wherein the passage means comprises a flux gap between the rotor and each of the stators.

9. A system according to claim 7, wherein coolant/lubricant is supplied to the flux gap by means of an inlet plenum communicating with the coolant/lubricant inlet.

10. An improved cooling and lubricating system for a marine propulsor, the propulsor including an electric motor with a rotor, a bearing assembly supporting the rotor, and a blade assembly including a plurality of propulsor blades and a blade hub attached to the rotor, the cooling and lubricating system comprising:

an inlet means in said propulsor through which coolant/lubricant is supplied to the bearing assembly and the motor, a passage means communicating with said inlet means through which the coolant/lubricant flows to cool and lubricate said bearing assembly and said motor, and outlet means communicating with said passage means located adjacent the trailing edge of the propulsor blade assembly through which the coolant/lubricant is expelled, and wherein the bearing assembly includes a bearing support, stationary bearing members and a rotating bearing member, wherein the motor includes a rotor mounted between a pair of stators, and wherein the inlet means comprises a coolant/lubricant opening in the bearing support and a coolant/lubricant inlet located in each of the stators, and wherein the passage means comprises a bearing clearance provided between the stationary bearing members and the rotating bearing member and a flux gap between the rotor and each of the stators.

11. A system according to claim 8, wherein coolant/lubricant is supplied to the flux gap by means of an inlet plenum communicating with the coolant/lubricant inlets and the bearing clearance communicating with a coolant/lubricant gap communicating with the coolant/lubricant opening.

12. An improved cooling and lubricating system for a marine propulsor, the propulsor including an electric motor with a rotor, a bearing assembly supporting the rotor, and a blade assembly including a plurality of propulsor blades and a blade hub attached to the rotor, the cooling and lubricating system comprising:

an inlet means in said propulsor through which coolant/lubricant is supplied to the bearing assembly and the motor, a passage means communicating with said inlet means through which the coolant/lubricant flows to cool and lubricate said bearing assembly and said motor, and outlet means communicating with said passage means located adjacent the trailing edge of the propulsor blade assembly through which the coolant/lubricant is expelled, and wherein the bearing assembly includes a stationary bearing support, a rotating bearing member and two stationary bearing members disposed adjacent to each other to form a coolant/lubricant gap communicating with the coolant/lubricant opening.

13. A system according to claim 10, wherein the motor includes a rotor mounted between a pair of stators, and the passage means comprises the coolant/lubricant gap formed between the two stationary bearing members, a bearing clearance located between the stationary bearing members and the rotating bearing member, an inlet plenum formed between each stator and each stationary bearing member, and a flux gap disposed between the rotor and each of the stators.

14. A system according to claim 13, wherein at least one coolant/lubricant inlet is located on each of the stators for supplying coolant/lubricant to the motor.

15. A system according to claim 14, wherein the coolant/lubricant inlet communicates with the inlet plenum.

16. An improved cooling and lubricating system for a marine propulsor, the propulsor including an electric motor with a rotor, a bearing assembly supporting the rotor, and a blade assembly including a plurality of propulsor blades and a blade hub attached to the rotor, the cooling and lubricating system comprising:

an inlet means in said propulsor through which coolant/lubricant is supplied to the bearing assembly and the motor, a passage means communicating with said inlet means through which the coolant/lubricant flows to cool and lubricate said bearing assembly and said motor, and outlet means communicating with said passage means located adjacent the trailing edge of the propulsor blade assembly through which the coolant/lubricant is expelled, and wherein the outlet means includes collector water passages axially disposed in the blade hub, an outlet disposed in the blade hub and through which the coolant/lubricant exits, and an effluent passage disposed in the blade hub and communicating with the collector water passages and the outlet.

17. An improved cooling and lubricating system for a marine propulsor, the propulsor including an electric motor with a rotor, a bearing assembly supporting the rotor, and a blade assembly including a plurality of propulsor blades and a blade hub attached to the rotor, the cooling and lubricating system comprising:

an inlet means in said propulsor through which coolant/lubricant is supplied to the bearing assembly and the motor, a passage means communicating with said inlet means through which the coolant/lubricant flows to cool and lubricate said bearing assembly and said motor, and outlet means communicating with said passage means located adjacent the trailing edge of the propulsor blade assembly through which the coolant/lubricant is expelled, and wherein the outlet means includes collector water passages axially disposed in the blade hub, a plurality of holes through which the coolant/lubricant exits located in the trailing edge of each of the propulsor blades, an intermediate exit passage disposed in the blade hub and communicating with the collector water passages, and an exit passage disposed in the blade and communicating with the intermediate exit passage and the plurality of holes.

18. The method of cooling and lubricating a marine propulsor having an electric motor with a rotor, a bearing assembly supporting the rotor and a blade assembly including a plurality of propulsor blades and a blade hub attached to the rotor while simultaneously augmenting the propulsion force of the propulsor and minimizing turbulence comprising, providing for the intake of a coolant/lubricant between the bearing assembly and the rotor, and conducting said coolant/lubricant from said bearing assembly and rotor out from said propulsor through an outlet means located in the trailing edge of the blade hub.

19. The method of cooling and lubricating a marine propulsor having an electric motor with a rotor, a bearing assembly supporting the rotor and a blade assembly including a plurality of propulsor blades and a blade hub attached to the rotor while simultaneously augmenting the propulsion force of the propulsor and minimizing turbulence comprising, providing for the intake of a coolant/lubricant between the bearing assembly and the rotor, and conducting said coolant/lubricant from said bearing assembly and rotor out from said propulsor through an outlet means located in the trailing edges of the blades.

* * * * *